US010389062B2

(12) United States Patent
Zebhauser et al.

(10) Patent No.: US 10,389,062 B2
(45) Date of Patent: Aug. 20, 2019

(54) PLUG CONNECTOR

(71) Applicant: ROSENBERGER HOCHFREQUENZTECHNIK GMBH & CO. KG, Fridolfing (DE)

(72) Inventors: Martin Zebhauser, Laufen (DE); Till Bredbeck, Traunstein (DE); Christian Schmidt, Wernberg-Köblitz (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/903,692

(22) PCT Filed: Jul. 8, 2014

(86) PCT No.: PCT/EP2014/001874
§ 371 (c)(1),
(2) Date: Jan. 8, 2016

(87) PCT Pub. No.: WO2015/003800
PCT Pub. Date: Jan. 15, 2015

(65) Prior Publication Data

US 2016/0164223 A1 Jun. 9, 2016

(30) Foreign Application Priority Data

Jul. 11, 2013 (DE) ..... 20 2013 006 297 U

(51) Int. Cl.
*H01R 13/58* (2006.01)
*H01R 24/28* (2011.01)
(Continued)

(52) U.S. Cl.
CPC ..... *H01R 13/5845* (2013.01); *H01R 13/506* (2013.01); *H01R 13/582* (2013.01); *H01R 13/6463* (2013.01); *H01R 24/28* (2013.01)

(58) Field of Classification Search
CPC .... H01R 13/506; H01R 9/035; H01R 13/516; H01R 13/58; H01R 13/6463;
(Continued)

(56) References Cited

U.S. PATENT DOCUMENTS 4,108,527 A * 8/1978 Douty ..... H01R 13/5825 439/465
4,421,376 A 12/1983 Cosmos
(Continued)

FOREIGN PATENT DOCUMENTS

DE 10065136 A1 7/2002
DE 202012007577 U1 9/2012
(Continued)

*Primary Examiner* — Edwin A. Leon
*Assistant Examiner* — Oscar C Jimenez
(74) *Attorney, Agent, or Firm* — DeLio Peterson & Curcio LLC; Robert Curcio

(57) ABSTRACT

A plug connector having a housing and at least one contact element which is fixed within the housing and is designed for connection to a wire of a cable, which wire is partially surrounded by a jacket, wherein the housing comprises two housing parts which are designed in such a way that they are fitted to one another in order to assemble the plug connector and are connected by being moved in the longitudinal direction of the plug connector until they reach an end position, wherein, owing to the movement, a part of at least of one of the housing parts, which part is provided for receiving a portion of the jacket, is radially deformed in order to fix the jacket.

13 Claims, 2 Drawing Sheets

(51) Int. Cl.
*H01R 13/506* (2006.01)
*H01R 13/6463* (2011.01)

(58) Field of Classification Search
CPC ..... H01R 13/582; H01R 13/5825; H01R 13/5845; H01R 13/585
USPC ..... 439/460, 465, 472
See application file for complete search history.

(56) References Cited

U.S. PATENT DOCUMENTS 5,100,345 A 3/1992 Endo
5,336,114 A * 8/1994 Wang ..... H01R 24/20 439/598
5,601,447 A * 2/1997 Reed ..... H01R 13/6463 439/404
5,957,732 A * 9/1999 Ito ..... H01R 13/506 439/701
6,062,900 A * 5/2000 Juntwait ..... H01R 12/772 439/495
6,126,478 A * 10/2000 Presson ..... H01R 13/595 439/467
6,152,770 A * 11/2000 Wang ..... H01R 13/506 439/598
6,165,012 A * 12/2000 Abe ..... H01R 4/2433 439/465
6,332,812 B1 * 12/2001 Kazuhara ..... H01R 13/514 439/701
6,402,568 B1 * 6/2002 Nagai ..... H01R 13/506 439/701
6,439,920 B1 8/2002 Chen
6,773,309 B1 * 8/2004 Shuey ..... H01R 13/4365 439/701
6,783,402 B2 * 8/2004 Chen ..... H01R 24/64 439/344
6,837,738 B1 * 1/2005 Chen ..... H01R 13/6477 439/418
7,785,153 B2 * 8/2010 Wang ..... H01R 13/506 439/668
7,950,968 B2 * 5/2011 Qian ..... H01R 9/03 439/466
8,070,506 B2 * 12/2011 De Dios Martin .. H01R 4/2433 439/409
9,722,348 B2 * 8/2017 Zebhauser ..... H01R 13/506
2009/0047840 A1 * 2/2009 Wang ..... H01R 13/506 439/668
2010/0227511 A1 * 9/2010 Qian ..... H01R 9/03 439/656
2012/0094525 A1 * 4/2012 Maranto ..... H01R 13/5829 439/460
2015/0079823 A1 * 3/2015 Lindblom ..... F21V 21/34 439/110
2015/0132994 A1 * 5/2015 Zebhauser ..... H01R 13/6585 439/607.06
2015/0349472 A1 * 12/2015 Zebhauser ..... H01R 13/6463 439/660

FOREIGN PATENT DOCUMENTS

IE 102012111129 A1 5/2014
WO 1997001874 A1 1/1997
WO 2012030462 A2 3/2012

* cited by examiner

PLUG CONNECTOR

BACKGROUND OF THE INVENTION

1. Field of the Invention

The invention relates to a plug connector with a housing and at least one contact element fixed within the housing which is designed for connection to at least one wire of a cable, the wire being partially surrounded by a cable jacket. The invention also relates to a system consisting of such a plug connector and a cable. In particular, the invention relates to a system consisting of a twisted-pair cable and a plug connector with two contact elements.

2. Description of Related Art

Twisted-pair cables have long been in use in the field of signal and data transmission. "Twisted-pair" refers to cables in which the wires (i.e., the conductors of the cable which are each surrounded by an insulating jacket) are twisted together in pairs. In comparison with cables in which the wire pairs are parallel, twisted-pair cables with their twisted wire pairs provide better protection against external alternating magnetic fields and electrostatic interference, since with a symmetrical signal transmission interference through external fields is largely cancelled out as a result of the twisting of the wire pairs.

Plug connectors are used to connect together electrically conductive components such as cables in an electrically conductive manner.

When connecting a twisted-pair cable with a conventional plug connector, the outer cable jacket surrounding the wires is removed in a section in which these are inserted within a housing of the plug connector. The ends of the conductors of the wires, which are in addition stripped of their insulating jacket, are then permanently connected with contact elements of the plug connector. The contact elements are in turn fixed within the housing. Within the housing, i.e., in the section from which the cable jacket has been removed, the wires run substantially parallel to one another. This section of the twisted-pair cable could thus be exposed to increased interference through external fields.

In order to avoid such increased interference, it is usual to integrate a shielding in the plug connector and in particular in the housing of the plug connector. However, this leads to relatively high costs for the plug connector, since it rules out the economic possibility of designing the housing exclusively of electrically insulating or non-conductive plastics.

In virtually all systems consisting of plug connector and cable it is relevant to create a strain relief for the connection of the wires with the contact element in order to prevent a tensile strain on the plug connector and cable jacket being transferred to this connection. The integration of a strain relief in such a system is generally associated with a relatively complex structure of the plug connector and consequently relatively high manufacturing costs, as well as with a relatively complex assembly of the system and consequently relatively high assembly costs. The costs per unit for the system are thus increased through the integration of a strain relief.

SUMMARY OF THE INVENTION

Bearing in mind the problems and deficiencies of the prior art, it is therefore an object of the present invention to provide a plug connector comprising: a housing; and at least one contact element fixed within the housing which is designed for connection to a wire of a cable, the wire being partially surrounded by a cable jacket, such that the housing includes two housing sections which are so designed that in order to assemble the plug connector they are placed against each other and connected by being moved relative to one another in the longitudinal direction of the plug connector until they reach an end position, wherein, owing to the movement, a part of at least of one of the housing sections provided for receiving a portion of the cable jacket is radially deformed in order to fix the cable jacket in place. The plug connector may include two parallel contact elements.

The radially deformable part of the housing section may include a projection, wherein the projection may be partially circular in form and/or tapers sharply in cross-section.

The housing sections are, in an end position, secured against disconnection in the longitudinal direction of the plug connector by a snap-lock connection.

Furthermore, as a result of the relative movement a projection on one of the housing sections engages in a recess in the other housing section, the housing sections are, in the end position, secured against disconnection transversely to the longitudinal direction of the plug connector.

The housing may be formed completely of electrically insulating plastic.

In a second aspect, the present invention is directed to a system including a plug connector and a cable with at least one wire surrounded by a jacket, the plug connector comprising: a housing; and at least one contact element fixed within the housing which is designed for connection to a wire of a cable, the wire being partially surrounded by a cable jacket, such that the housing includes two housing sections which are so designed that in order to assemble the plug connector they are placed against each other and connected by being moved relative to one another in the longitudinal direction of the plug connector until they reach an end position, wherein, owing to the movement, a part of at least of one of the housing sections provided for receiving a portion of the cable jacket is radially deformed in order to fix the cable jacket in place.

The system may include two parallel contact elements, as well as a twisted-pair cable with two twisted wires surrounded by a jacket, wherein the wires within the housing may be laid in a twisted arrangement which continues the twisting of the twisted-pair cable, and the wires may be laid in the twisted arrangement directly up to the contact elements.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
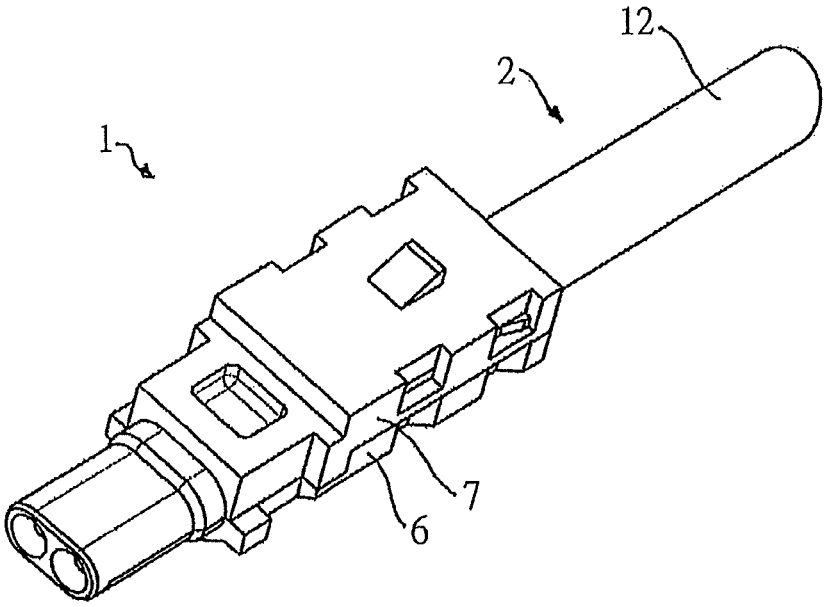
FIG. 1 shows a first perspective view of a system according to the invention.
Figure 2:
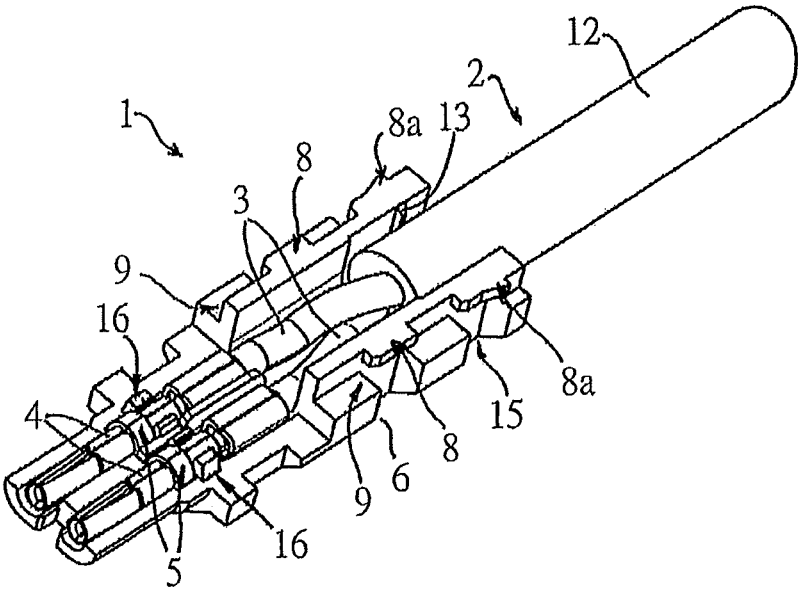
FIG. 2 shows the system according to FIG. 1 without the upper housing section.
Figure 3:
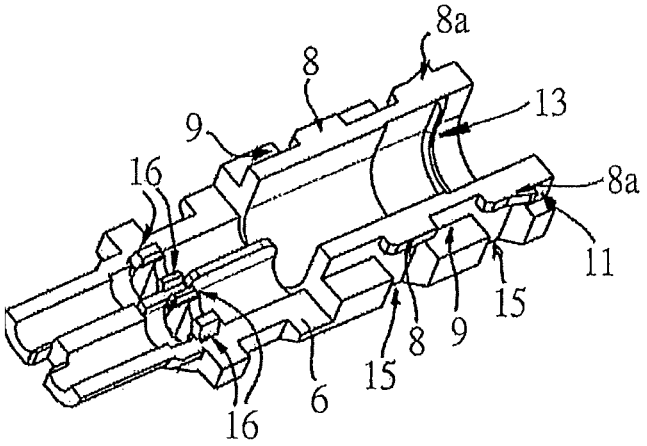
FIG. 3 shows a perspective view of the lower housing section of the system according to FIG. 1.
Figure 4:
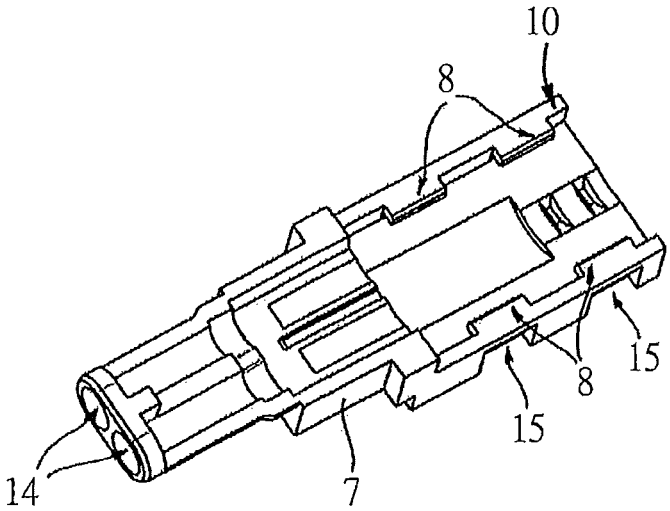
FIG. 4 shows a perspective view of the upper housing section of the system according to FIG. 1.

In describing the preferred embodiment of the present invention, reference will be made herein to FIGS. 1-4 of the drawings in which like numerals refer to like features of the invention.

Starting out from this prior art, the invention was based on the problem of providing a system consisting of a plug connector and a cable, in particular a twisted-pair cable, the unit costs of which are as low as possible.

This problem is solved by means of a plug connector and a system according to the independent claims. Advantageous embodiments of the plug connector according to the invention and of the system according to the invention are the subject matter of the different dependent claims and are explained in the following description of the invention.

According to the invention, a plug connector of the generic type, with a housing and at least one contact element arranged within the housing, which is designed for connection with at least one wire of a cable, the wire being surrounded by a jacket, is developed further in that the housing (possibly in addition to further housing components) comprises two housing sections which are so designed that in order to assemble the plug connector they are placed against each other and are connected by being moved relative to one another in the longitudinal direction of the plug connector until they reach an end position, wherein, owing to the movement, a part of at least of one of the housing sections, which part is provided for receiving a portion of the jacket, is radially deformed in order to fix (preferably clamp) the jacket in place.

According to the invention, "longitudinal direction" is understood to mean that orientation which is defined through the relative movement of the plug connector in relation to a mating connector when these elements are plugged together. In particular, the longitudinal direction of the plug connector can thus correspond in orientation to a longitudinal axis of the contact element.

The jacket can in particular refer to the (wire) jacket directly surrounding the conductor (referred to collectively as a wire) or to the cable jacket surrounding several conductors or wires.

The design of the plug connector according to the invention allows a fixing of the jacket to the housing which performs the function of a strain relief for the connection between the wire and the contact element to be realized in an economical manner, in terms of both manufacture and assembly. In addition, the radial deformation of the housing is at least partially transmitted to the generally flexible jacket, which also leads to a clamping of the conductor(s) running within the jacket.

In order to improve the fixing of the jacket in the housing it can preferably be the case that the radially deformable part of the housing section includes a projection. During the radial deformation, this projection can penetrate into the jacket, which is preferably made of a readily deformable material, thus forming a kind of form-locking connection. The projection can in particular be partially circular in form (at least in one section) and/or taper sharply in cross-section.

In order to guarantee a permanent connection of the housing sections in the end position, these can, in the end position, be secured against disconnection in the longitudinal direction of the plug connector by a snap-lock connection. The snap-lock connection can be designed to be permanent or releasable (without damage).

A "snap-lock connection" is understood to mean a form-locking connection which acts through the spring-loaded engagement of a projection on one housing section into a recess in the other housing section.

Alternatively or in addition to the snap-lock connection, the housing sections can also be connected in the end position by force-locking means.

In addition, in a further preferred embodiment of the plug connector according to the invention, the housing sections can, in the end position, be secured against disconnection transversely (in particular perpendicular) to the longitudinal direction of the plug connector. This securing can in particular take the form that, as a result of the relative movement, at least one projection of one of the housing sections engages in at least one corresponding recess in the other housing section.

A system according to the invention comprises at least one plug connector according to the invention as well as a cable connected thereto with at least one wire surrounded by a jacket, wherein the at least one wire is connected with the at least one contact element in an electrically conductive manner and a section of the jacket is fixed in at least one of the housing sections.

In a further preferred embodiment of the plug connector according to the invention, (at least) two, preferably parallel, contact elements are provided. Such a plug connector is suitable for a connection to the (at least) two twisted wires (preferably cores) of a twisted-pair cable, as is the case in a preferred embodiment of the system according to the invention.

In a preferred embodiment of such a system according to the invention, it can then be the case that the wire strands or cores within the housing are laid in a twisted arrangement which continues the twisting of the twisted-pair cable (i.e., in particular with an identical length of lay). Particularly preferably, the twisting arrangement is continued, as far as possible, directly up to the contact elements.

Through such an embodiment of the system according to the invention, the good transmission properties of twisted-pair cables can also largely be achieved for the plug connector without any need for a shielding of the plug connector. Consequently, as is preferably the case, the housing can be formed completely of electrically insulating plastic and in particular does not include any shielding. This allows the manufacturing costs for the plug connector according to the invention to be kept low. This is particularly so if, as is also preferably the case, the housing sections are manufactured through injection molding without further subsequent processing such as, for example, partial metallic coating.

The fixing of the jacket in the housing of the plug connector according to the invention can already adequately ensure that the twisting of the wire strands or cores is continued within the housing. This applies in particular if the fixing of the cable jacket is (also) such that this is secured against a twisting of the jacket in the housing. In addition, it can prove particularly advantageous if the radial deformation of the housing is transmitted via the flexible jacket to the wire strands or cores, which are thus clamped in the twisted arrangement and thus fixed in place. However, alternatively or additionally, the housing of the plug connector according to the invention can also be so designed that it forms a guide through which the wire strands or cores are fixed in a twisted arrangement which continues the twisting of the twisted-pair cable. For example, the walls of a guide space within the housing can be designed correspondingly in the spatial form of the wire strands or cores which are laid in the intended twisted arrangement. Alternatively or additionally, at least one, preferably two or more guide pins can be provided which are arranged in the guide space within which the wire strands or cores are laid. The wire strands or cores can be guided in curves around these pins, through which, in combination with the inner walls of the guide space, the twisting of the wire strands or cores can be fixed. The pins thereby preferably extend transversely and in particular perpendicular to a plane which is spanned by longitudinal axes of the two contact elements, which are preferably elongated and in particular cylindrical in form. It can particularly preferably be the case that the pins are arranged at an identical distance from the longitudinal axes of the two contact elements. This supports a fundamentally desirable largely symmetrical guidance of the wire strands or cores and thus a largely corresponding length of the sections of the wire strands or cores of the twisted-pair cable guided within the housing, which can have a positive effect on the electrical properties of the system according to the invention.

FIG. 1 shows a system according to the invention, which comprises a plug connector 1 according to the invention and a (twisted-pair) cable 2 with two twisted wires 3, the cable 2 being electrically and mechanically connected to the plug connector 1.

In addition to a two-section housing, the plug connector 1 has two contact elements 4 which are mounted in fixed positions in the housing and which have plug-side as well as cable-side ends. On the cable-side ends the contact elements 4 are in each case connected with a stripped section of the conductor of one of the two wires 3 of the cable 2 by crimped connections. The plug-side ends are designed to make contact with complementary contact elements of a mating plug connector (not shown), whereby the socket-formed contact elements 4 of the plug connector 1 receive pin-formed contact elements of the mating plug connector and are thereby widened elastically in a radial direction, which is made possible through a corresponding longitudinal split in the contact elements.

The fixing in position of the contact elements 4 within the housing is in each case realized through a circumferential projection 5 of the contact elements 4 which is arranged in a circumferential groove of the housing.

The housing of the plug connector comprises two housing sections, a first housing section 6, shown at the bottom in FIG. 1, as well as a second housing section 7, shown at the top in FIG. 1. Each of the housing sections 6, 7 comprises a plug-side section, in which the contact elements 4 are arranged in the assembled condition of the plug connector 1. In this section, the dividing plane between the housing sections 6, 7 is coplanar with the plane spanned by the longitudinal axes of the two contact elements 4 (which, with the exception of the crimped connections, are circular or annular in cross-section). Each housing section 6, 7 also comprises a cable-side section which is designed to receive the section of the cable 2 received in the housing. In this section, the dividing plane runs parallel to the plane spanned by the longitudinal axes of the two contact elements 4.

In the respective cable-side sections, each of the housing sections 6, 7 form four projections 8 adjacent the dividing plane, wherein two projections 8 are arranged on each side of each of the housing sections 6, 7, spaced apart in the longitudinal direction of the plug connector. These two projections 8 also form a limit for a recess 9 extending in a longitudinal direction on each side of each of the housing sections 6, 7.

In order to assemble the plug connector 1 the two housing sections 6, 7 are positioned offset from one another in the longitudinal direction such that the projections 8 of one of the housing sections 6, 7 are arranged next to the projections 8 of the other housing section 7, 6. This allows the housing sections 6, 7 to be plugged together (in a direction perpendicular to the longitudinal direction) until the contact surfaces of both housing sections 6, 7 forming the dividing plane make contact, without the projections 8 colliding. The projections 8 of both housing sections 6, 7 are then located in the recesses 9 of the other housing section 7, 6.

The housing sections 6, 7 are then connected by sliding the two housing sections 6, 7 relative to one another in the longitudinal direction until the end position shown in FIG. 1 is reached. In this end position the four projections 8 of both housing sections 6, 7 at least partially overlap each other. This prevents the housing sections 6, 7 from becoming disconnected in a direction transverse to the longitudinal direction of the plug connector 1.

A disconnection of the housing sections 6, 7 in the longitudinal direction is prevented by means of a snap-lock connection. The snap-lock connection is formed by two cable-side projections 8*a* of the first housing section 6 in interaction with a cable-side end section 10 of the second housing section 7.

These projects 8*a* are designed to widen in the direction of the cable-side end of the first housing section 6, so that contact surfaces of the projections 8*a* running obliquely to the longitudinal direction are formed. The end section 10 of the second housing section 7 is pushed onto these contact surfaces, whereby the inner width of the end section 10 is smaller than the maximum width defined by the two widening projections 8*a*. The end section 10 of the second housing section 7 is therefore widened elastically as it passes over the widening projections 8*a*, so that it snaps behind these projections 8*a* into the end position.

However, on snapping behind the projections 8*a*, the end section 10 of the second housing section 7 cannot completely return to its original form but, elastically widened, presses against contact surfaces of an end section 11 of the first housing section 6. For this purpose, the first housing part 6 has a greater width in the region of these contact surfaces than in the region of the recesses 9.

As a result of the end section 10 of the second housing section 7 being elastically widened and thus pretensioned when in contact, the end section 11 and in part the adjoining section of the first housing section 6 are deformed radially inwards, as a result of which the receiving space formed in the first housing section 6 is reduced in these sections. This leads to a clamping fixing of the cable jacket 12 of the cable 2 positioned in these sections. This fixing serves, on the one hand, as a strain relief for the connection between the contact elements 4 and the conductors of the cable 2 and is intended on the other hand to prevent the cable 2 from twisting within the housing.

The connection of the cable 2 in the housing is further improved through a circumferential (around the longitudinal direction of the plug connector) projection 13 in the wall of the receiving space, arranged in the vicinity of the end section 11, which has a sharply tapering cross-section. As a result of the deformation of the first housing section 6 this projection 13 penetrates into the cable jacket 12, forming a kind of form-locking connection.

The wires 3 of the cable 2 are disposed within the housing in a twisted arrangement, also in the section from which the cable jacket 12 has been stripped. The twisting arrangement in this section corresponds as closely as possible to that which the wires 3 follow within the cable jacket 12. Through the fixing of the plug-side ends of the conductors in the contact elements 4, which are in turn fixed within the housing, as well as through the securing of the cable jacket 12 against twisting through the clamping fixing, it can be adequately ensured that the twisting arrangement is not disturbed in the section of the cable 2 from which the cable jacket 12 has been stripped.

The two housing sections 6, 7 of the plug connector 1 are formed completely of non-electrically-conductive plastic, whereby the simple geometric form advantageously makes injection molding possible. In a demolding apparatus which is oriented perpendicular to the dividing planes, only the second housing section 7 has undercuts in the form of plug-side through-openings 14, which can be created with the aid of a slide in the injection mold. Due to the provision of demolding recesses 15, the projections 8 do not represent undercuts during demolding.

A shielding for the plug connector integrated in the housing is not provided. Due to the twisting of the wires 3 substantially being continued as far as the contact elements 4, the transmission behavior of the system for radio frequency signals is sufficiently good for many applications.

In order to assemble the system, a defined section of the cable 2 is first stripped of the cable jacket 12. This section is so dimensioned that in the assembled state the cable jacket 12 extends, with a defined length, into the receiving space of the housing. The wires 3 are then stripped of their insulation in defined sections at their plug-side end, i.e., the conductors of the wires 3 are stripped of their protective jackets in these sections. The stripped ends of the conductors are then connected with the contact elements 4 through crimping. The contact elements 4 and the relevant cable section are then laid in the first housing section 6, whereby the required twisting arrangement of the exposed section of the wires 3 is introduced. Even a slight clamping of the cable jacket 12 in the end section 11 of the first housing section 6 due to the oversized cable jacket 12 as well as the fixing of the contact elements 4 through snap-lock connections, which is achieved in each case by two locking latches 16, thereby already prevents the twisting of the exposed wires 3 from becoming undone. The second housing section 7 is then pushed onto the first housing section 6 in the manner already described. As a result of the now firmer fixing of the cable jacket 12 in the housing as a result of the radial deformation of the first housing section 6, the strain relief is realized and a disturbance of the twisting arrangement prevented, even during later use of the system subject to relatively high handling forces.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connector comprising:

a housing; and at least one contact element fixed within the housing which is designed for connection to a wire of a cable, said wire being partially surrounded by a cable jacket, such that the housing includes two housing sections configured to be assembled and placed against each other and connected by being moved relative to one another in a longitudinal direction of the plug connector until they reach an end position, wherein, due to the movement, a part of at least one of the housing sections, provided for receiving a portion of the cable jacket, is radially deformed in order to fix the cable jacket in place, and to the housing which performs the function of a strain relief for the connection between the wire and the at least one contact element, wherein the longitudinal direction of the plug connector is parallel to a dividing plane between the two housing sections in a plug side section.

2. The plug connector of claim 1, wherein the radially deformable part of the housing section includes a projection.

3. The plug connector of claim 2, wherein the projection is partially circular in form and/or tapers sharply in cross-section.

4. The plug connector of claim 3, wherein the housing sections are, in an end position, secured against disconnection in the longitudinal direction of the plug connector by a snap-lock connection.

5. The plug connector of claim 4, wherein as a result of the relative movement a projection on one of the housing sections engages in a recess in the other housing section, so that the housing sections are, in the end position, secured against disconnection transversely to the longitudinal direction of the plug connector.

6. The plug connector of claim 1, wherein the housing sections are, in an end position, secured against disconnection in the longitudinal direction of the plug connector by a snap-lock connection.

7. The plug connector of claim 1, wherein as a result of the relative movement a projection on one of the housing sections engages in a recess in the other housing section, so that the housing sections are, in the end position, secured against disconnection transversely to the longitudinal direction of the plug connector.

8. The plug connector of claim 1, wherein the housing is formed completely of electrically insulating plastic.

9. The plug connector of claim 1, including two parallel contact elements.

10. A system including a plug connector and a cable with at least one wire surrounded by a jacket, said plug connector comprising:

a housing; and at least one contact element fixed within the housing which is designed for connection to a wire of a cable, said wire being partially surrounded by the cable jacket, such that the housing includes two housing sections configured to be assembled and placed against each other and connected by being moved relative to one another in the longitudinal direction of the plug connector until they reach an end position, wherein, due to the movement, a part of at least one of the housing sections, provided for receiving a portion of the cable jacket, is radially deformed in order to fix the cable jacket in place, and to the housing which performs the function of a strain relief for the connection between the wire and the at least one contact element, wherein the longitudinal direction of the plug connector is parallel to a dividing plane between the two housing sections in a plug side section.

11. The system of claim 10 including two parallel contact elements, as well as a twisted-pair cable with two twisted wires surrounded by the jacket.

12. The system of claim 11, wherein the wires within the housing are laid in a twisted arrangement which continues the twisting of the twisted-pair cable.

13. The system of claim 12, wherein the wires are laid in the twisted arrangement directly up to the contact elements.

* * * * *